US006892478B1

(12) United States Patent
Erickson et al.

(10) Patent No.: US 6,892,478 B1
(45) Date of Patent: May 17, 2005

(54) TEMPERATURE-STABILIZED ARTICLES

(76) Inventors: John J. Erickson, 26 Westwood Ave., Brockton, MA (US) 02301; Peter A. Daley, 13830 CR 7A Box 177, Yampa, CO (US) 80483; Robert W. Gardner, 59 Mace Rd., Hampton, NH (US) 03892; Michael B. Browning, 378 Baxter Rd., Winston-Salem, NC (US) 27107; Thomas Baranek, 102 W. Decatur St., Madison, NC (US) 27025; Douglas K. Robinson, 481 Fruit St., Mansfield, MA (US) 02048; Douglas J. McCrosson, 40 Tucker Dr., Bayport, NY (US) 11705; Chang Woo Nam, 313-602 Karak Town Apt., 1176 Hadan Dong, Saha Xu, Pusan (KR)

( * ) Notice: Subject to any disclaimer, the term of this patent is extended or adjusted under 35 U.S.C. 154(b) by 0 days.

(21) Appl. No.: 10/009,032

(22) PCT Filed: May 19, 2000

(86) PCT No.: PCT/US00/14007

§ 371 (c)(1),
(2), (4) Date: Sep. 20, 2002

(87) PCT Pub. No.: WO00/70983

PCT Pub. Date: Nov. 30, 2000

Related U.S. Application Data

(60) Provisional application No. 60/135,374, filed on May 21, 1999.

(51) Int. Cl.[7] ..... A43B 13/38; A43B 7/02

(52) U.S. Cl. ..... 36/43; 36/2.6; 36/45; 428/283; 428/320.2

(58) Field of Search ..... 36/43, 2.6, 44, 36/3 R, 3 B, 71, 45, 54; 428/283, 320.2, 304.4, 309.9, 317.9

(56) References Cited

U.S. PATENT DOCUMENTS

| | | | | |
|---|---|---|---|---|
| 3,635,849 | A | 1/1972 | Hanson | 260/2.5 B |
| 4,504,402 | A | 3/1985 | Chen et al. | 252/70 |
| 4,856,294 | A | 8/1989 | Scaringe et al. | 62/259.3 |
| 5,499,460 | A | 3/1996 | Bryant et al. | 36/43 |
| 5,542,196 | A | 8/1996 | Kantro | |
| 5,637,389 | A | 6/1997 | Colven et al. | |
| 5,784,811 | A | 7/1998 | Mauch | |
| 5,827,459 | A | 10/1998 | Allen et al. | |
| 6,004,662 | A | 12/1999 | Buckley | 428/304.4 |

FOREIGN PATENT DOCUMENTS

| | | |
|---|---|---|
| EP | WO 94/02257 | 2/1994 |
| EP | WO 95/34609 | 12/1995 |

*Primary Examiner*—M. D. Patterson
(74) *Attorney, Agent, or Firm*—Cooley Godward LLP

(57) ABSTRACT

Articles and products for preventing or minimizing temperature increase of a person or object (see the figure). The articles include a base material, and at least one temperature-stabilizing material integral with and dispersed throughout the base material. The temperature-stabilizing materials can be phase change materials and have phase change temperatures. Products can contain a plurality of articles and each article can have a phase change temperature the same as or different than those of other articles in the product. Products include footwear, protective apparel and the like.

14 Claims, 3 Drawing Sheets

TEMPERATURE-STABILIZED ARTICLES

This application claims the benefit of Provisional Application No. 60/135,374, filed May 21, 1999.

The invention generally relates to the field of articles comprising phase change material-containing material. It is particularly, but not exclusively, suited for use in shoes designed for use in various athletic endeavors, such as tennis shoes, basketball shoes, golf shoes, etc. It is also suited for work shoes, dress shoes, boots, overshoes, climbing or hiking footwear, and other footwear, as well protective articles.

BACKGROUND OF THE INVENTION

A long-standing goal has been to provide comfortable footwear for active uses, which can prevent against temperature rise of the feet during such activity. Previously available temperature-controlled insoles are described in U.S. Pat. No. 5,499,460 to Bryant et al. Such footwear articles include phase change-type materials in microcapsules which are in a base material.

SUMMARY OF THE INVENTION

The invention is based on the discovery that footwear, protective apparel, apparel accessories and the like, can include an article containing temperature-stabilizing material, or alternatively, components of at least two types, each containing temperature-stabilizing material, which article can effectively maintain an individual or object at a comfortably or suitably low temperature. Temperature-stabilizing material is integral to, and dispersed throughout the article. In certain embodiments at least two types of components have different temperature-stabilizing material having distinct phase change temperatures, chosen to provide maximum protection against temperature increase, for example, to provide a footwear user with maximum comfort under active conditions. The results of this increased comfort include enhanced performance, greater stamina and a higher level of enjoyment of such activities. The specific manner, and locations of temperature-stabilizing material are described herein.

As used in the claims and specification, "normal skin surface temperature" refers to the temperature range of skin surface temperatures (particularly of the foot) from about 88° F. to about 94° F.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

Other features and advantages of the invention will be apparent from the following detailed description, and from the claims.

DETAILED DESCRIPTION

Figure 1:
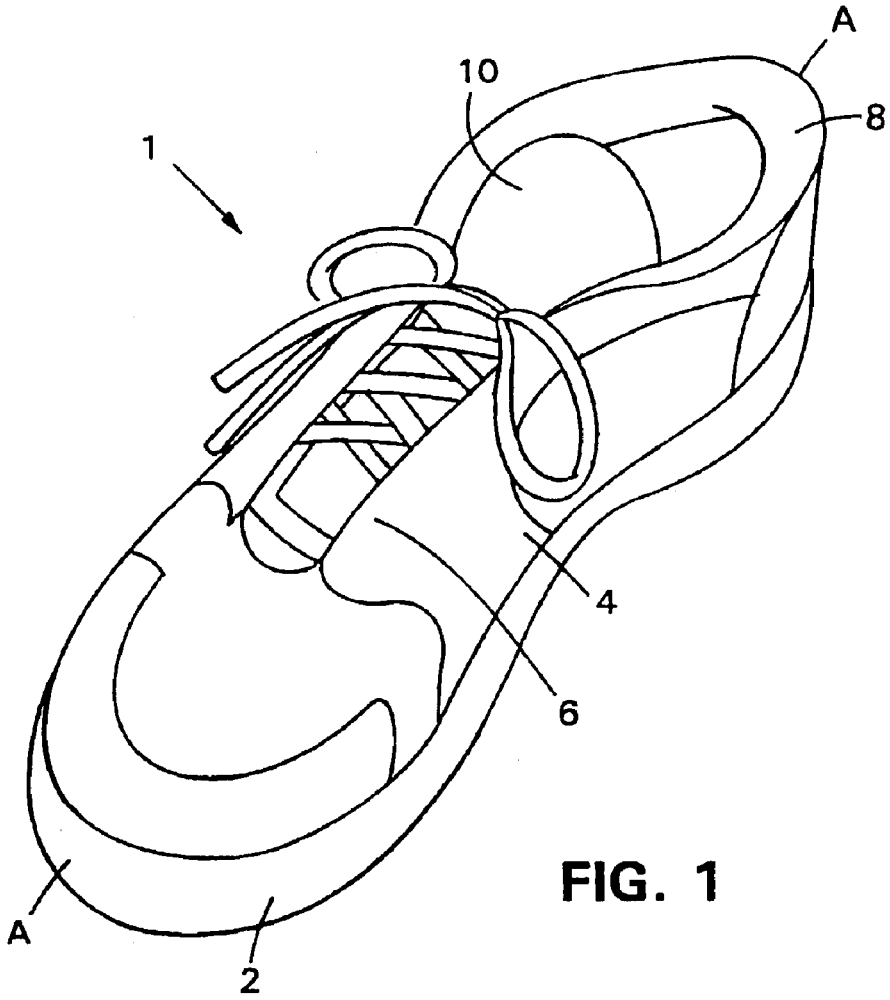
FIG. 1 is a perspective view showing various portions of a shoe.

The inventive articles described herein provide increased resistance to temperature increase of persons or objects in contact with the articles. When employed in footwear, the articles provide increased comfort to the user, by inhibiting temperature rise of the feet which can otherwise occur under active conditions. The inventive articles employed in footwear are directed to providing cooling foot comfort to the wearer under warm ambient conditions, as well as to wearers undertaking physical activity. Further, particularly with respect to footwear containing temperature-stabilizing materials with multiple phase change temperatures, the inventive articles allow fabrication of travel, athletic or leisure footwear which can extend the seasonality or geographic scope of the footwear. Travelers can equally comfortably utilize footwear made with temperature-stabilizing articles in a cool environment and a warm environment. Similarly, footwear useful for an outdoor sport such as golf, for example, can be equally comfortably used in cold and hot weather without the need for alternating footwear. Thus, the temperature-stabilizing articles find utility in travel/adventure shoes, as well as in golf footwear.

Foot temperature inside shoes is influenced by a number of factors, including heat input from a warm surface upon which the wearers walk, heat input from direct sunlight, heat generated from the body which cannot easily be dissipated to the environment through typical shoes made to keep exterior or outside moisture away from the foot, and by frictional forces between the foot and inner shoe surfaces, as well as by other processes. Thus, the foot can be effectively viewed as a microclimate. By controlling and minimizing as many of these heat sources as possible, undesirable increases in foot temperature can be minimized. Above a given temperature, the feet begin to feel uncomfortable. Although this temperature varies according to individual tolerances, temperatures above approximately 95° F. may begin to be perceived as uncomfortable. The goal of the invention is to provide the feet with a quasi-equilibrium temperature which is perceived to be comfortable by the wearer.

In one aspect, the invention involves products, such as footwear, including articles having a temperature-stabilizing material with a phase change temperature, which temperature-stabilizing material are incorporated into a flexible and resilient base material. The phase change temperature associated with the article is selected to minimize the temperature rise of a person or object, particularly during physical exertion of the person. In addition to footwear, the base material can be adapted to be positioned within protective and apparel products such as footwear, helmets, elbow, knee or shin guards, or straps for a backpack, for example.

In another aspect, the invention involves the use of footwear including at least two types of articles, each of which includes a temperature-stabilizing material, each type having a distinct phase change temperature, and each incorporated into a flexible and resilient base material. For example, one phase change temperature can be below normal skin temperature and another phase change temperature can be above normal skin temperature.

The invention as a whole acts to reduce the temperature rise of a person (for example of their feet) during activity.

This is accomplished by providing temperature-stabilizing material with specific phase change temperatures or specific positioning of temperature-stabilizing material for the maintenance of a particularly comfortable skin temperature. The article, for example, footwear maintains a perception of coolness for an extended time, against the rise in foot temperature which would otherwise occur.

When incorporated into articles of footwear, the inventive article can be used in, for example, shoes of many general types. Preferred among shoes are those which substantially protect the foot from external conditions. Thus, sandals or other substantially open shoes are not generally useful for the purposes of the invention. Other shoes which are considered useful for the invention are those which, for reasons of their function, require the foot to be substantially enclosed. Such shoes include athletic shoes, including shoes for basketball, tennis, golf, volleyball, baseball, football, soccer, hiking, climbing, and similar indoor and outdoor sports and activities. Other shoes which are useful in the present invention are work shoes, and work boots. Particularly useful are shoes which are to be used in warm environments.

In FIG. 1, shoe 1 which can be useful in the present invention is shown. The shoe has sole 2, connected at its edges to upper 4. Upper 4 includes such parts as vamp 6, and collar portion 8. Also included is tongue 10.

Figure 2:
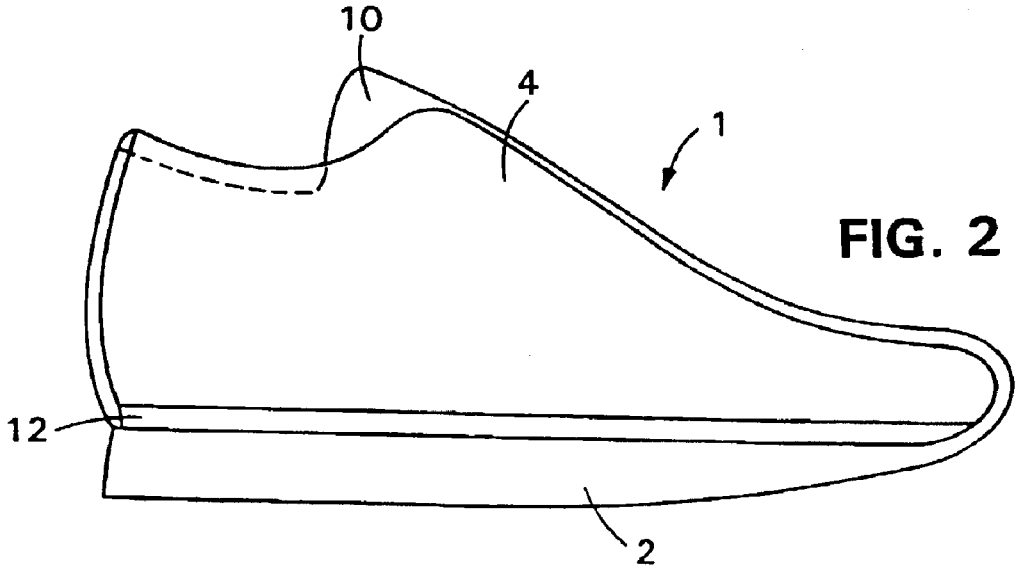
FIG. 2 is a longitudinal cross sectional view of a shoe.

In FIG. 2, a longitudinal cross section of shoe 1 generated between points A of FIG. 1 is shown. FIG. 2 shows insole 12. The insole is generally of the same general shape and dimension as the sole of the shoe, and rests either directly or indirectly on the footbed of the shoe, which rests on the sole. The shoe is constructed according to general methods of shoe construction known to those of ordinary skill in the art.

The articles can take the form of footwear components to be deployed in various parts of a shoe. These articles include a base material. The base material can comprise a number of different materials, such as liquids, gels, foamed solids or nonfoamed solids. The base material desirably provides a convenient thermal path between the foot and the temperature-stabilizing material (described below) within the base material. Without a base material, the temperature-stabilizing material is not optimized to receive heat and prevent temperature increases of the foot. A base material can be flexible in parts of the shoe that typically experience flexing during wear. Other parts of the shoe which are not expected to undergo much flexing can include base materials which are less flexible, including ground cork and like materials. These materials can be used, for example, in the sole of the shoe.

Among desirable base materials are flexible and resilient materials such as polymeric material. Useful polymeric base materials such as a moldable foamed organic plastic are envisioned for use in the invention. Examples of acceptable polymeric materials are polyurethane, ethylene/vinyl acetate (EVA) copolymer, latex, polyethylene, polypropylene, butadiene, silicone, cellulose acetate, neoprene, epoxy, polystyrene, rubber and polyvinyl chloride (PVC). These materials may be foamed or not, according to the particular material selected. Foamed base material has air-containing pockets, or cells, which can either be open or closed, depending on the particular application. A useful material has been found to be a open cell, polyurethane foam obtained from Time Release, Inc. (Niagara Falls, N.Y.).

Particularly useful polymeric base materials for some applications are those with high compression resistance. This property gives good shock absorbing ability without compromising the distribution of temperature-stabilizing material. A polymeric base material with high compression resistance also possesses resistance to impact, contributing to protective properties which are useful in some applications. Such properties are desirable, for example, when an article is used in footwear and is under repeated pressure from ambulation. Preferred compression resistant polymeric base materials have a compression set of 20% or less, for example 15% or less, more preferably 10% or less.

Particularly useful polymeric base materials for some applications are those which are thermoformable, that is, those which can be shaped to assume a desired shape by the application of heat. Thermoformability of polymeric base materials leads to ease and versatility in manufacture of products containing articles employing such materials. Preferred polymeric base materials are thermoformable at temperatures below about 300° F., in order that the particular temperature-stabilizing material not be irreversibly affected by extreme temperatures.

Particularly useful polymeric base materials are those which can be loaded with effective amounts of temperature-stabilizing material. Some known polymeric base materials are limited in their capacity to integrally contain temperature-stabilizing material, since increased loading can compromise the structure of these polymeric base materials. For example, polymeric base materials useful in articles described herein can contain from about 15% to about 35% temperature-stabilizing material by weight, based on the weight of polymeric base material. Preferred polymeric base materials can contain from about 20% to about 35% temperature-stabilizing material by weight, or from about 20% to about 30%. Suitably thin layers of such base materials can contain at least about 400 g/m$^2$ of temperature-stabilizing material such as microencapsulated phase change material. More preferably, useful polymeric base materials include at least about 425 g/m$^2$ of THERMASORB® 83, for example, 450 g/m$^2$ of THERMASORB® 83.

Particularly useful polymeric base materials are those with specific gravities above about 0.75, for example, above about 0.80, or preferably, above about 0.90, more preferably, above about 0.93, for example, 0.922 or 0.934.

Particularly useful polymeric base materials are those with high durometer ratings. The Durometer Hardness Test can be found in ASTM standard D 1706 and D 2240. This test measures depth of indentation under a load when a hardened steel indentor is pressed into a sample with a calibrated spring force. A durometer of type A is used for nonrigid materials. Preferred polymeric base materials have hardnesses, for example, of at least 20 Shore A, or preferably at least 21 Shore A, more preferably at least 22 Shore A, for example 23 Shore A or more, when the base material is unloaded with temperature stabilizing material. When polymeric base material is loaded to 30% by weight with temperature-stabilizing material (for example, THERMASORB® 83), the hardnesses are desirably at least about 5 Shore A, more preferably at least about 10 Shore A, and more desirably at least about 15 Shore A. Excessive hardness can be undesirable for articles used in some applications, either for reasons of potential brittleness or for comfort of the material when in contact with a person. For example, for applications in which the article is used as a footwear component in the insole region of footwear, Shore A hardnesses are preferably less than about 35.

Particularly useful polymeric base materials are those with tensile strength above about 8 kg/cm$^2$, preferably above about 10 kg/cm$^2$, for example, 11 kg/cm$^2$. Particularly useful polymeric base materials are those with elongations of about 800%. Particularly useful polymeric base materials are those with abrasion resistance of 44% (NBS). Particularly useful polymeric base materials are those with tear strength of at least 3 kg/cm, for example at least 3.6 kg/cm, or at least 5.3 kg/cm. Particularly useful polymeric base material are those with resiliencies of at least 40%, for example at least 43% or at least 47%. Preferred polymeric base materials are those which possess the above qualities simultaneously when loaded to about 30% by weight with temperature-stabilizing material, for example, THERMASORB® 83. The test methods for the determination of these properties are the appropriate ASTM test methods.

A particularly useful polymeric base material has a combination of the properties of high compression resistance, resilience, thermoformability, loading, high specific gravity, durability, tensile strength, elongation and abrasion resistance described above. Non-foamed polymeric base materials can be suitable. Non-foamed polymeric base materials do not tend to hold moisture, which can lead to corrosion, bacterial growth, and associated odor, contamination and the like. Suitable base materials have been found to be, for example, butadiene rubber, styrene butadiene rubber, natural rubber, nitrile butadiene rubber, ethylene propylene-diene rubber, ethylene propylene rubber and silicone rubber. These materials can be fabricated as solids, gels or foamed solids according to methods known to those of skill in the art. Other base materials which may be suitable include polyurethane, acryl latex, and natural latex. In some preferred embodiments, rubbers are suitable, such as butadiene rubber.

Different polymeric materials can be used as base materials in the inventive articles to be used in different parts of the article. For example, in applications in which the article is employed in a shoe, desirably, a denser, more durable base material, such as a non-foamed material can be used for the insole portion of the shoe. For example, a base material to be used in the insole portion of a shoe can comprise polyurethane, or another resilient polymer. A preferred base material for an insole is polyurethane foam, or in some applications, butadiene rubber applied to a polyurethane foam or other traditional insole.

For upper portions of a shoe, it is desirable that the base material be somewhat less dense, and more breathable than in other portions of a shoe. For example, a base material to be used in the tongue, vamp, or collar portion of the shoe can comprise a styrene-butadiene random or block copolymer, or a styrene-butadiene polymer blend, which can be foamed or not foamed.

Similarly, the densities of foamed polymers can vary from about 3 pounds per cubic foot to about 15 pounds per cubic foot. Preferably, the densities can vary from about 4 to about 12 pounds per cubic foot. The densities of the foamed base material can be different for articles to be used in different parts of a product. For example, the density of the base material to be used in articles such as footwear components used in the insole region of a shoe can range from about 3 to about 15 pounds per cubic foot, but is preferably from about 6 to about 12 pounds per cubic foot. The density of the base material to be used in articles such as footwear components to be placed in the tongue, vamp or collar portions of a shoe can also range from about 3 to about 15 pounds per cubic foot, but preferably lower, in the range of from about 4 to about 8 pounds per cubic foot.

The densities of polymeric base materials that are not foamed can be higher, for example, specific gravities for nonfoamed polymeric base material in an article used as a footwear component in an insole region of a shoe can be at least about 0.75, preferably at least about 0.80, more preferably at least about 0.85, even more preferably at least about 0.88. In other applications in which compressive or other forces are less, the specific gravities of the base material can be less, to lighten the articles or to increase flexibility. Specific gravities for nonfoamed polymeric base material to be used in an upper portion of a shoe (tongue, vamp or collar) can be at least about 0.6.

Similarly, the thickness of the base material can vary from about 0.5 to about 10 mm, preferably from about 1.0 to about 6 mm. For base material in an article such as a footwear component to be used as the insole portion of a shoe, we prefer the range from about 0.5 mm to about 6 mm.

For comfort and feel, the base material can be covered with a number of materials, including fabrics, polymeric materials, and other covering materials which do not substantially impede heat transfer between the person or object to be kept cool and the base material. For surfaces of the article which are not meant to contact the person or object to be kept cool, this restriction does not apply.

Temperature-Stabilizing Material

The temperature-stabilizing material can be encapsulated in microcapsules (called MicroPCM), or in larger capsules. Microcapsules offer a greater surface area for a given amount of temperature-stabilizing material however, which leads to more efficient heat transfer from the base material. Encapsulated temperature-stabilizing material can be encapsulated in leak resistant microcapsules. Further, the microencapsulated temperature-stabilizing materials can be individually surroundingly encapsulated and embedded within the base material. Additionally, substantially all the microcapsules can be spaced apart from each other, the space between neighboring adjacent microcapsules being base material, or, if the base material is foamed, base material and air or other gas. Microcapsules of temperature-stabilizing material can range in size from about 1.0 to about 1000 microns and are formed according to conventional methods well known to those of skill in the art.

The temperature-stabilizing material can be a phase change-type material. The phase change materials remove some of the heat from the sorbent material simply through storage of sensible heat. In other words, they heat up as the heat source (foot and surrounding shoe material, for example) heats up, removing heat from the heat source. However, the most effective function of the phase change material is in the phase change itself. An extremely large quantity of heat is absorbed by a suitable phase change material in connection with the phase change (that is, change from a solid phase to a liquid phase, or change from a liquid phase to a vapor phase). There is typically no change in the temperature of the phase change material during the phase change, despite the relatively substantial amount of heat required to effect the change, which heat is absorbed during the change. Phase change materials which change from a solid to a liquid, absorbing from the sorbent their latent heat of fusion, are the most practical in a closed system.

Suitable phase change materials for particular applications may be selected from paraffin, naphthalene, sulphur, hydrated calcium chloride, bromocamphor, cetyl alcohol, cyanamide, eleudic acid, lauric acid, hydrated sodium silicate, sodium thiosulfate pentahydrate, disodium phosphate, hydrated sodium carbonate, hydrated calcium nitrate, Glauber's salt, potassium, sodium and magnesium acetate.

Examples of such phase change materials are paraffinic hydrocarbons having carbon chain lengths of between about 13 and 30 carbon atoms. Additionally, materials such as 2,2-dimethyl-1,3-propanediol (DMP), and 2-hydroxymethyl-2-methyl-1,3-propanediol (HMP) and the like can be used as the temperature-stabilizing material.

| Compound | Number of | Melting Point |
|---|---|---|
| n-Octacosane | 28 | 61.4 |
| n-Heptacosane | 27 | 59.0 |
| n-Hexacosane | 26 | 56.4 |
| n-Pentacosane | 25 | 53.7 |
| n-Tctracosane | 24 | 50.9 |
| n-Tricosane | 23 | 47.6 |
| n-n-Docosane | 22 | 44.4 |
| n-Heneicosane | 21 | 40.5 |
| n-Eicosane | 20 | 36.8 |
| n-Nonadecane | 19 | 32.1 |
| n-Octadecane | 18 | 28.2 |
| n-Heptadecane | 17 | 22.0 |
| n-Hexadecane | 16 | 18.2 |
| n-Pentadecane | 15 | 10.0 |
| n-Tetradecane | 14 | 5.9 |
| n-Tridecane | 13 | −5.5 |

Each of the above materials can be separately encapsulated and is most effective near the melting point indicated. The materials can also be blended within individual capsules or microcapsules to give temperature-stabilizing materials of a virtually continuous range of phase change temperatures. It will be seen from the foregoing that the effective temperature range of the article can be tailored to operate optimally in a specific environment by selecting the phase change temperature and adding microcapsules containing the corresponding temperature-stabilizing material to the article. As mentioned, in one aspect, the products can include at least two types of articles having at least two different temperature-stabilizing materials. According to this aspect, each type of article functions to stabilize a different temperature, and can be located in a different part of the product.

For the present invention, it is desirable that the phase change material used in the article according to one aspect of the invention undergo its phase change at a temperature which is somewhat lower than the skin temperature of person at rest. Resting skin temperatures (including resting foot temperatures) can range from about 88° F. to about 95° F. (that is, from about 31° C. to about 35° C.). Elevated skin temperatures can range from about 90° F. to about 98° F. and above. Therefore it is desirable that phase change material to be used in this aspect of the present invention undergo its phase change at temperatures of about 78° F. to about 100° F. (that is, from about 25° C. to about 38° C.). Preferably, the phase change material undergoes its phase change at temperatures from about 80° F. to about 86° F. (that is, from about 26.6° C. to about 30.0° C.) or from about 92° F. to about 98° F. (that is, from about 33.3° C. to about 36.6° F.).

Microencapsulated phase change materials are available, for example, from Frisby Technologies (Winston-Salem, N.C.). One such suitable material is THERMASORB® 83, which undergoes a solid-liquid phase transition at about 83° F. (that is, 28.3° C.). Another such suitable material is THERMASORB® 95, which undergoes a solid-liquid phase transition at about 95° F. (that is, 35° C.). Another such suitable material is THERMASORB® 65, which has a solid-liquid phase transition temperature of about 65° F. (that is, 18.3° C.). Another such suitable material is THERMASORB® 122, which has a solid-liquid phase transition temperature of about 122° F. (that is, 50° C.). These materials are able to absorb between about 165 and 210 Joules per gram of THERMASORB® microcapsules. These materials can be blended in a polymeric base material to create articles with a range of transition temperatures. Such blends can be made homogeneously (that is, even distribution of temperature-stabilizing materials of more than one type throughout a polymeric base material), or non-homogeneously (that is, concentration of a particular temperature-stabilizing material in one region of a base material, and concentration of another temperature-stabilizing material in another region of the base material). Alternatively, temperature-stabilizing materials can be distributed non-evenly within a base material, so that they are localized, for example, in a region of higher expected heat input, or heat loss than another region having either less, or even no, temperature-stabilizing material.

According to another aspect of the invention, it has been found that it can be important for comfort that there be a perception of coolness to be experienced by the wearer of a shoe immediately upon putting the shoe on. This perception leads to immediate satisfaction with the product and leads to increased confidence on the wearer's part that the shoe inhibits excessive temperature rise of the foot. This perception can be achieved by equipping the footwear with a first type of article having a first phase change material that undergoes a first temperature transition above typical ambient temperature (so that the phase change material is solid when the shoe is at a typical ambient temperature). At the same time, the first phase change temperature should be below that of normal resting skin temperature, so that the phase change material immediately begins removing heat from the foot. Thus, the first phase change temperature will be selected according to considerations of both normal resting foot temperature, and an expected ambient temperature for the environment in which the shoe is likely to be used. These ambient temperatures can range up to about 95° F.

For further benefits according to this further aspect of the invention, the footwear is equipped with a second type of article, having a second phase change material that undergoes a phase change at a temperature above that of normal resting skin temperature but below a temperature at which the feet feel excessively hot (approximately 97° F.). The second phase-change temperature-stabilizer acts to minimize temperature rise of the foot after the foot has reached a somewhat elevated temperature which is associated with vigorous activity.

Generally, the phase-change transition temperatures of the first and second phase-change materials are different from each other by about 5° F. to about 30° F. In a particular embodiment, the first phase-change temperature-stabilizer undergoes a transition from about 75° F. to about 90° F., or preferably from about 78° F. to about 87° F., or more preferably from about 80° F. to about 85° F.

In a particular embodiment, the second phase-change temperature-stabilizer undergoes a transition from about 85° F. to about 105° F., or preferably from about 88° F. to about 102° F., or more preferably from about 90° F. to about 100° F. In a particularly preferred embodiment, the first phase change temperature is from about 78° F. to about 87° F., and the second phase change temperature is from about 88° F. to about 102° F. For avoiding the effects of an extreme heat, a third phase change material can be included with an even higher phase change temperature, for example from about 110° F. to 130° F.

In fabricating articles according to the invention, the desired encapsulated phase change materials are added to a polymeric base material (liquid, solution, suspension, dispersion or slurry) and fabrication is accomplished according to conventional methods which may include foaming. A foamed base material can be formed by selecting a liquid polymer and/or elastomer and then causing it to be foamed. Common methods of foaming are disclosed in U.S. Pat. No. 5,499,460 to Bryant, and other methods are well known to those skilled in the art. Non-foamed polymeric base material can be cured, crosslinked, or otherwise brought to a substantially solid state by means known to those of skill in the art.

The temperature-stabilizing material (for example, MicroPCM) can be added to the liquid polymer/elastomer prior to hardening or curing and mixed therein to insure wetting and equal dispersion throughout the mixture. Alternatively, but less desirably, the temperature-stabilizing material can be placed into a hardened or cured polymer/elastomer by such means as skiving under a knife edge.

One important parameter of the articles is the loading (weight of temperature-stabilizing material per weight of base material) of polymeric base material. High loading can increase the ability of the article to absorb heat, while excessive loading has the potential drawback that so much of the generally more thermally conductive base material is replaced with generally less thermally conductive temperature-stabilizing material that the article does not easily transmit heat to the temperature-stabilizing material. This can result in decreased thermal coupling between the heat source (foot) and heat sink (for example, microencapsulated phase change material, or MicroPCM). Further, high loading can alter the structure of the base material, and thereby its properties, which may be important for the utility of the base material. So there exists a balance between efficient heat transfer through the base material, and base material functionality on the one hand, and heat uptake capability on the other. It should also be noted that, generally, the higher the loading (increasing the capacity for heat uptake), the more energy transfer required to regenerate the phase change material.

Typical concentrations of microencapsulated phase change materials added to the base polymer material in a range from about 20% to about 60% by weight, preferably from about 25% to about 50%. The loading range can be different for different densities of foam, so that a less dense foam will be able to be loaded to a lesser extent while retaining its essential characteristics and properties for use in the invention than a denser foam would be. Foams of density of about 3 pounds of base material per cubic foot will generally be loaded with microPCM up to about 40–50% by weight. Foams of densities of about 9 pounds of base material per cubic foot will generally be loaded with microPCM up to about 50–60% by weight.

The loading can be different for articles to be placed in different parts of a product. For example, for an article used as a footwear component, to be placed in the position of an insole, the loading can be from about 20% to about 60%, or from about 30% to about 50% (that is, 40% microcapsules by weight of base polymer). For an article used as a footwear component to be placed in the tongue, vamp or collar portion of a shoe, the loading can be from about 20% to about 60%, or from about 20% to about 40%.

When the product is a shoe, such shoes can contain from about 2 to about 16 ounces of microPCM per pair of shoes. Thus, a pair of shoes according to the invention can absorb from about 350 to about 4000 Joules of heat. Preferably, a pair of shoes according to the invention is designed to absorb from about 1000 to about 3500 Joules of heat, and more preferably from about 2000 to about 3500 Joules of heat.

The articles can be placed in any part of the product. When the product is a shoe, and the article is a footwear component which can act as a portion of, or the entirety of any of these parts of footwear: an insole, a tongue, a vamp, a collar, sides, a heel, and other portions of a shoe where the prevention of temperature rise of the feet is desirable, and good thermal contact can be made with the foot. Some areas of the foot are more thermally sensitive than others, and the inventive articles as footwear components can be especially effective if incorporated into parts of the shoe meant to contact these areas, for example, the instep of the foot. Certain areas of a shoe will alternatively make good thermal contact with the ground surface and can prevent the temperature rise of the wearer's feet in that way. The method of attachment of the articles is not critical to the invention. Typically, the articles are glued or sewn into the product, for example, into the footbeds of shoes. Shoes can also be made so that the footwear components are integral to the shoes and attachment is not required. General methods of manufacturing shoes are well known to those of skill in the art. It will be apparent to one of ordinary skill in the art, upon reading this detailed description, how to go about manufacturing a shoe generally described herein.

Figure 3:
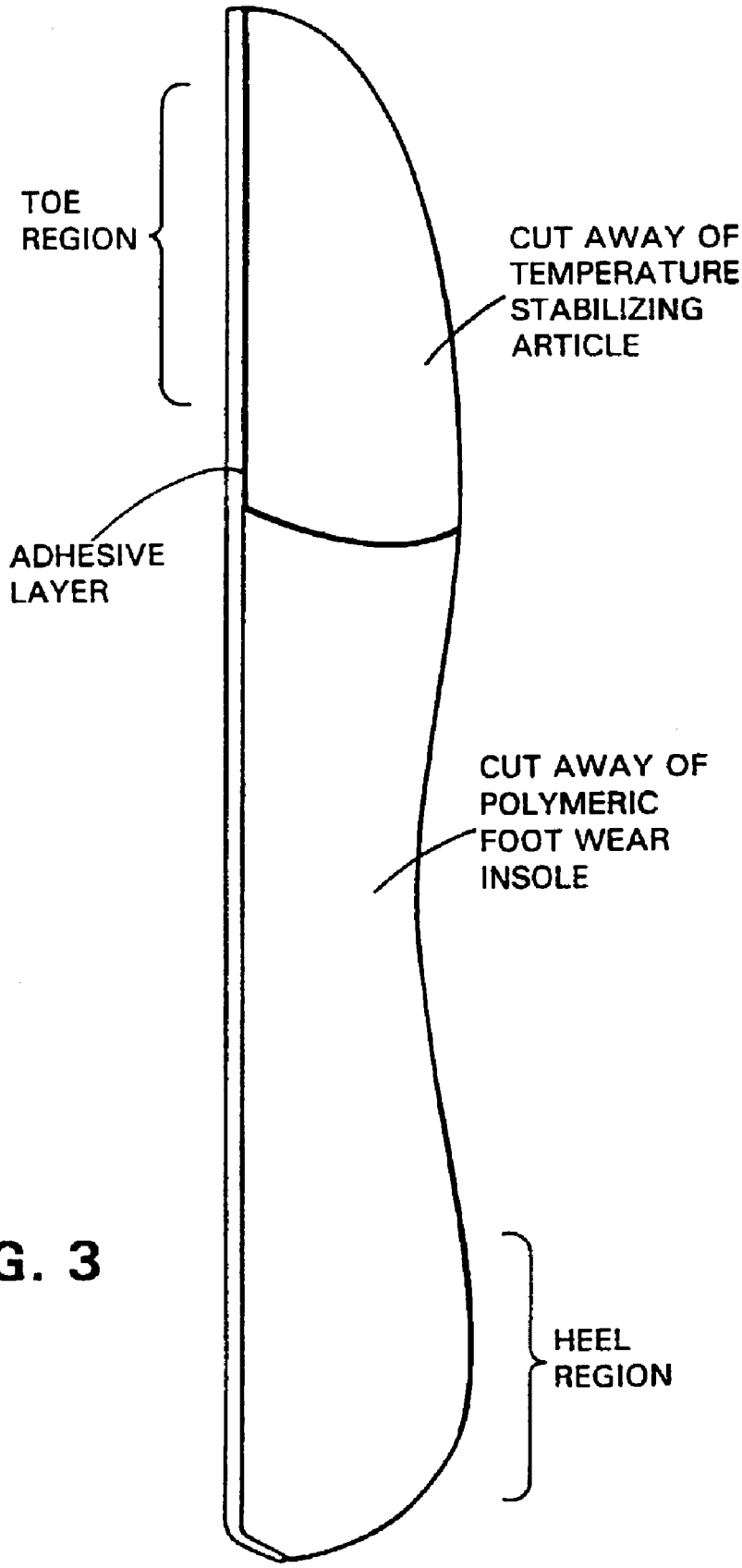
FIG. 3 is a perspective view of a footwear insole according to a particular embodiment of the invention.

In a particular example, an article comprising a butadiene rubber base material and microencapsulated phase change material can be incorporated into a shoe insole, for example in the heel region, or in the toe crest. Shoe insoles can be made of a polymeric material having high compression resistance. Suitable materials for footwear insoles include polyurethane, ethylene/vinyl acetate (EVA) copolymer, latex, polyethylene, polypropylene, butadiene, silicone, cellulose acetate, neoprene, epoxy, polystyrene, rubber and polyvinyl chloride (PVC). In some preferred embodiments, closed cell foamed EVA copolymer is suitable. FIG. 3 shows a shoe insole featuring a temperature-stabilizing article in the toe crest area. The temperature-stabilizing article can be attached to a non-temperature stabilizing material by any suitable means, such as by chemical adhesive, or physical means of attachment. In some embodiments, the temperature-stabilizing material can be applied directly to a substrate (for example, a shoe insole to create a footwear component with temperature-stabilizing properties), and, for example, cured *in situ*. Some substrate materials will need to be treated after production to accept temperature-stabilizing material. For example, EVA typically has a "skin" on its surface after molding, which can be removed by several methods, including treatment with a solvent, for example, acetone.

In another embodiment, temperature-stabilizing material is dispersed throughout a base material of ground cork and inserted into the sole of a shoe or boot. Typically, an inner portion of a rubber sole can be hollowed out and the rubber replaced with a less dense material without sacrificing the strength of the sole. This less dense material can be a footwear component as described above.

The temperature-stabilizing ability of the articles can be initially realized, or regenerated, by placing the article, or product containing the article, in an environment which is below the phase transition temperature of the temperature-stabilizing material of the article or product, for a period long enough to convert all (or at least part of) the liquid material into solid material.

The invention further provides a method of preventing the temperature rise of a person or object. The method comprises thermally charging (or regenerating) an article substantially as described above. Thermal charging involves ensuring that at least some, preferably all, of the phase change type material is in the solid phase. This can be done by leaving the article, or product containing the article, in ambient temperature which is below the phase transition temperature of the phase change type material, or by placing the article or product in a refrigerator or other cool place for the same purpose. The article or product are then placed in contact with a person or object, for example, with a wearer's feet. Physical activity (including strenuous physical activity such as hiking, climbing, running, walking, engaging in sports including basketball, football, baseball, volleyball, soccer, and the like) can then be undertaken without the temperature rise of the feet which would be experienced while wearing conventional shoes.

The invention will be further described in the following examples, which do not limit the scope of the invention described in the claims.

EXAMPLES

The following examples illustrate the properties of certain embodiments of the invention.

Example 1

Treadmill Testing

The treadmill test was carried out as follows. A test subject was given socks and a pair of shoes to wear. Care was taken that the fit of the shoes was proper, as it had previously been observed that improper shoe fit can give unreliable results.

Foot temperatures were measured by an Agema 570 IR camera in an environmentally controlled room (room temperature was 72° F.; 22.2° C.; humidity 40%). Each test subject sat on a stool, with their calves over another stool to ensure that the feet were suspended in air and not making any contact with the other foot or the ground during measurement. Foot temperatures were recorded as the average recordings of three different areas of the foot: the bottom of the foot, the instep or top of the foot, and the arch of the foot. An initial foot temperature was recorded, prior to exercise, which is the baseline. Immediately prior to exercise, another measurement was taken, which is time zero. Subjects walked at 2.5 mph on a Precor C964 treadmill (no incline) for 45 minutes. Every five minutes, the treadmill was stopped, and the subject proceeded directly to the stools, removed the test shoes and socks and measurement of the foot temperature was undertaken immediately. The subject then replaced the socks and shoes on the feet and continued the treadmill test. After 45 minutes, the subject rested and foot temperature was taken again (resting).

The configuration of the footwear according to certain embodiments of the invention was as follows.

Footwear according to Example 1 is the FootJoy Dry I.C.E. golf shoe with 2.3±0.25 mm of 83° F. phase change material-containing foam in the tongue lining and collar portions of the shoe, and 2.75±0.25 mm of 83° F. phase change material-containing foam in the insole of the shoe.

This particular exemplary embodiment of the invention was compared to footwear without any phase change material present, or with phase change material present only in the insole of the shoe. The configuration of the footwear according to Comparative Examples was as follows.

Footwear according to Comparative Example 1 is the FootJoy DryJoys GX golf shoe, with phase change material in the insole portion of the shoe. This shoe has a 2.75±0.25 mm thick, 9 pound per cubic foot polyurethane foam as the insole, loaded to 40% by weight with phase change material undergoing a phase change at about 83° F. (28.3° C.).

Footwear according to Comparative Example 2 is the FootJoy DryJoy golf shoe without any phase change material incorporated. Footwear according to Comparative Example 3 is the Etonic Difference Tour golf shoe. Footwear according to Comparative Example 4 is the Reebok DMX Trac golf shoe. Footwear according to Comparative Example 5 is the Etonic Difference golf shoe. Footwear according to Comparative Example 6 is the Nike SSL golf shoe. Footwear according to Comparative Example 7 is the Adidas Saddle Stripe golf shoe. Footwear according to Comparative Example 8 is the Nike Air Zoom Tour T≠C golf shoe.

Figure 4:
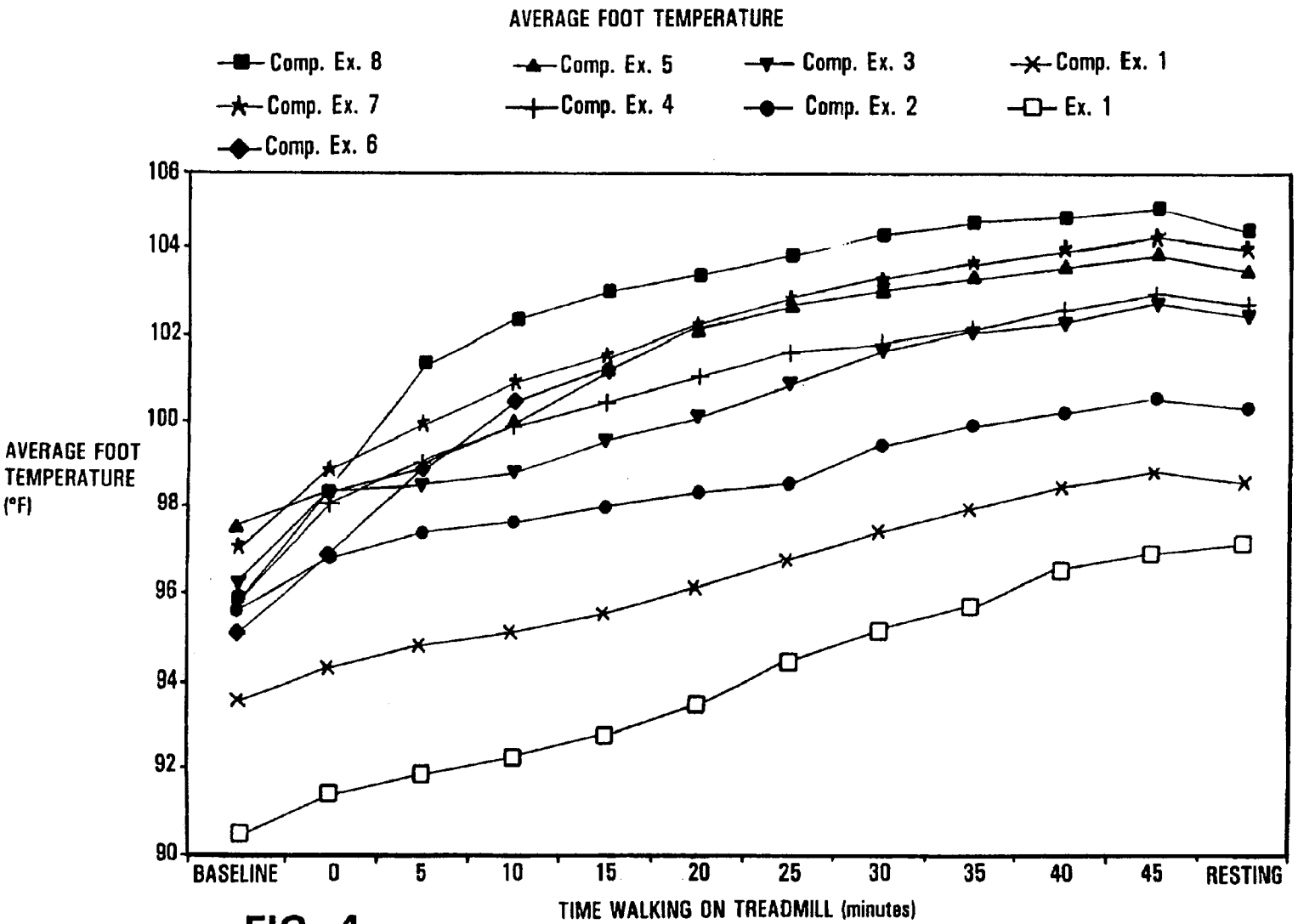
FIG. 4 is a graph of average foot temperature measurements taken before, during, and after a 45 minute treadmill test for various shoes.

The resulting time-temperature graph is shown in FIG. 4. The baseline temperatures for all of the products without phase change material were in a tight range between 95.07 to 97.47° F. The baseline temperatures for subjects' feet wearing the footwear of Example 1 and Comparative Example 1 were lower, due to the immediate cooling effect of the phase change material-containing foams in these shoes. As the subjects walked, their feet temperature increases while wearing footwear according to Comparative Examples 3–8 were all greater than those while wearing footwear according to Comparative Examples 1 or 2, or Example 1. After only 5 minutes, the foot temperature of subjects wearing footwear according to Comparative Example 2 was over 1° F. cooler than that of those wearing footwear according to Comparative Example 3, and 4° F. cooler than that of those wearing footwear according to Comparative Example 8. The difference in temperatures had widened by the end of the test, so that the foot temperature of subjects wearing footwear according to Comparative Example 2 was 2.2° F. cooler than that of those wearing footwear according to Comparative Example 3, and 4.4° F. cooler than that of those wearing footwear according to Comparative Example 8.

The footwear containing phase change material in the insole (Comparative Example 1), and in the insole, tongue, and collar (Example 1) resulted in an even more dramatic prevention of the rise of foot temperature of the subjects. These footwear showed a reduction in the subjects' foot temperature from the time they were put on, throughout the test, and to the end of the test.

The footwear according to Comparative Example 1 reduced subjects' foot temperature approximately 4° F. compared to Comparative Example 3, and over 6□F compared to Comparative Example 6.

The footwear according to Example 1 reduced subjects' foot temperature approximately 6 to 6.5° F. compared to Comparative Example 3, and 7.5 to 10° F. compared to Comparative Example 8.

Surprisingly, after 45 minutes of waling, the subjects wearing the footwear according to Example 1 had approximately the same foot temperature as subjects wearing footwear according to Comparative Examples 3–8 had before ever walking.

Example 2

Butadiene Rubber-Containing Temperature-Stabilizing Material

Butadiene rubber containing 30% by weight (based on the weight of the rubber) of microencapsulated phase change material, or MicroPCM (THERMASORB®, Frisby Technologies; Winston-Salem, N.C.) was prepared and physical properties below were measured by standard testing methods according to ASTM standards. One sample contained THERMASORB® 83 (Sample A) and one sample contained THERMASORB® 95 (Sample B).

TABLE 1

Properties of MicroPCM-containing Butadiene Rubber

| | Sample A | Sample B |
|---|---|---|
| Hardness (Shore A) | 15 | 7 |
| Specific Gravity | 0.934 | 0.922 |
| Tensile Strength ($kg/cm^2$) | 11.3 | 10.3 |
| Elongation (%) | 788 | 900 |
| Tear Resistance (kg/cm) | 5.3 | 3.6 |
| Resiliency (%) | 47.7 | 43.6 |

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A shoe comprising:

(a) a sole;

(b) an insole disposed on said sole;

(c) an upper attached to said sole, said upper including:

(i) a vamp; and (ii) a collar attached to said vamp; and (d) a tongue attached to said upper;

wherein said insole includes a first polymeric material and a first microencapsulated phase change material dispersed in said first polymeric material, at least one of said tongue, said vamp, and said collar includes a second polymeric material that is less dense than said first polymeric material and a second microencapsulated phase change material dispersed in said second polymeric material, and said first microencapsulated phase change material and said second microencapsulated phase change material have different phase change temperatures.

2. The shoe according to claim 1, wherein one of said first microencapsulated phase change material and said second microencapsulated phase change material has a phase change temperature in the range of 78° F. to 87° F., and another of said first microencapsulated phase change material and said second microencapsulated phase change material has a phase change temperature in the range of 88° F. to 102° F.

3. The shoe according to claim 1, wherein one of said first microencapsulated phase change material and said second microencapsulated phase change material has a phase change temperature below normal resting skin temperature, and another of said first microencapsulated phase change material and said second microencapsulated phase change material has a phase change temperature above normal resting skin temperature.

4. The shoe according to claim 1, wherein said first polymeric material is a first foamed polymeric material having a density in the range of 6 $lb/ft^3$ to 12 $lb/ft^3$.

5. The shoe according to claim 4, wherein said first foamed polymeric material is a polyurethane foam.

6. The shoe according to claim 1, wherein a loading of said first microencapsulated phase change material in said first polymeric material is from 30% to 50% by weight of said first polymeric material.

7. The shoe according to claim 1, wherein said first polymeric material has a specific gravity above 0.90, a tensile strength of at least 10 $kg/cm^2$, a tear resistance of at least 3 kg/cm, a resiliency of at least 40%, and a hardness of at least 20 Shore A.

8. The shoe according to claim 7, wherein said hardness is at least 22 Shore A.

9. The shoe according to claim 1, wherein said first polymeric material is a non-foamed rubber.

10. The shoe according to claim 1, wherein said second polymeric material is a second foamed polymeric material having a density in the range of 4 $lb/ft^3$ to 8 $lb/ft^3$.

11. The shoe according to claim 10, wherein said second foamed polymeric material is a polyurethane foam.

12. The shoe according to claim 1, wherein a loading of said second microencapsulated phase change material in said second polymeric material is from 20% to 40% by weight of said second polymeric material.

13. The shoe according to claim 1, wherein said first microencapsulated phase change material and said second microencapsulated phase change material absorb from 2,000 Joules to 3,500 Joules of heat during use of said shoe.

14. The shoe according to claim 1, wherein said first microencapsulated phase change material and said second microencapsulated phase change material absorb heat to prevent a temperature rise of more than 30° F. above ambient temperature during use of said shoe.

* * * * *